US005572775A

United States Patent [19]

Mailloux et al.

[11] Patent Number: 5,572,775

[45] Date of Patent: Nov. 12, 1996

[54] CLOTHES HANGER CLIP

[76] Inventors: Steve Mailloux, 3438 Cunard Ct., San Jose, Calif. 95132; Herb Neumann, 425 Pinehurst Ave., Los Gatos, Calif. 95032

[21] Appl. No.: 442,271

[22] Filed: May 16, 1995

[51] Int. Cl.[6] ..... A47F 5/00

[52] U.S. Cl. ..... 24/339; 24/335; 24/338; 211/123

[58] Field of Search ..... 24/339, 338, 337, 24/336, 335; 211/123, 124, 8

[56] References Cited

U.S. PATENT DOCUMENTS

| | | | |
|---|---|---|---|
| 372,039 | 10/1887 | Mohlberg | 24/336 |
| 1,778,168 | 10/1930 | Rotberg | 24/338 |
| 1,966,283 | 7/1934 | Brody | 211/123 |
| 2,460,997 | 2/1949 | Myers | 211/123 |
| 3,021,958 | 2/1962 | Winkler | 211/124 |
| 4,037,728 | 7/1977 | Cameron | 211/124 |
| 4,760,929 | 8/1988 | Fedorchak | 211/123 |
| 5,018,627 | 5/1991 | Moore | 211/123 |
| 5,076,447 | 12/1991 | De Beer | 211/124 |

*Primary Examiner*—Victor N. Sakran
*Attorney, Agent, or Firm*—Keith Kline

[57] ABSTRACT

A hanger clip adapted specifically for the dry cleaning industry. The device includes an elongated main body. At each end of the main body are a pair of hanger securing means. The hanger securing means are adapted to clip around the throat portion of a hanger. The hanger clip is inserted into the group of hangers through the open area of the hangers, and is moved upward to the throat of the hanger until the clips are secured on the throats of two terminal hangers in the desired group. The clip also includes a scanner identifiable tag.

3 Claims, 3 Drawing Sheets

CLOTHES HANGER CLIP

FIELD OF THE INVENTION

The present invention relates generally to drycleaning accessories, and more particularly is a grouping device for clothes hangers.

BACKGROUND OF THE INVENTION

The present invention is directed to the drycleaning industry, where it is a requirement that clothing on hangers be grouped according to customer. Because of the high volume of garments, the cleaned clothes cannot each be segregated, but rather must all be placed in one or two hanging areas. This situation leads to the necessity of somehow being able to segregate the garments for each individual customer. The current method of grouping customers' orders is to simply tie them together with wire twist-ties. This method is cumbersome and time-consuming, and is not conducive to an efficient, high-volume operation.

An area in which some attention has been paid to the grouping of hangers is in travel or moving situations. There are several efforts in the prior art directed to holding hangers in fixed positions. While these devices are not specifically adapted to grouping items, they do all provide means to secure hangers.

One such prior art device is the "GARMENT BAG HANGER SUPPORT", by Myers et al., U.S. Pat. No. 4,732,270. This device utilizes a hinged mechanism wherein a lower arm includes multiple notches to receive the hangers and hold them in place. The lower arm is clamped shut against an upper, fixed arm.

Another device aimed at fixing hangers in position is the "HOLDER TO POSITION CLOTHES HANGERS RELATIVE TO ONE ANOTHER" by De Beer, U.S. Pat. No. 5,076,447. This device is oriented horizontally to clamp on the neck of the hanger as opposed to the Myers device which clamps on the hook portion.

A third device is the "GARMENT-HANGER BAR" by Becker, U.S. Pat. No. 3,318,460. This device is adapted to fit into a corrugated cardboard garment moving box. The device includes end pieces which fit over the walls of the box, an upright member which receives the hooks of the hangers, and a lateral member that includes multiple depressions to receive the necks of the hangers.

All these devices, while presumably affective for their intended use, are not adaptable to the dry cleaning business. Because they are designed with supporting the hanger and the clothes thereon, the devices have a relatively expensive material demand for manufacturing. The construction of the prior art devices makes them impossible to adapt to the dry cleaning field because of the cost and bulk of the devices. Further, the dry cleaning field requires that various sizes of a hanger clip be easily available, and devices such as those in the prior art, which require relatively complex manufacturing, do not easily lend themselves to flexibility in size.

OBJECTS, SUMMARY, AND ADVANTAGES OF THE INVENTION

Accordingly, it is an object of the present invention to provide a device for the dry cleaning industry that will segregate groups of clothing on hangers.

It is a further object of the present invention to provide a device that is inexpensive so that they can be utilized in large quantities.

It is a still further object of the present invention to provide a device that is easily installed into hangers in a group, each hanger holding a garment.

It is a still further object to provide a means to easily track the orders by an automated tracking system.

In summary, the present invention is a hanger clip adapted specifically for the dry cleaning industry. The device comprises an elongated main body. At each end of the main body are a pair of hanger securing means. The hanger securing means are adapted to clip around the throat portion of a hanger. The hanger clip is inserted into the group of hangers through the open area of the hangers, and is moved upward to the throat of the hanger until the clips are secured in the throats of two terminal hangers in the desired group. The clip also includes a scanner identifiable tag.

An advantage of the present invention is that it allows the user to quickly and easily segregate groups of garments on hangers.

Another advantage of the present invention is that it is simple and inexpensive to manufacture.

A further advantage of the present invention is that the clips can be chained together to segregate any number of garments on hangers.

A still further advantage of the present invention is that the canner identifiable tag allows the order to be tracked by automated means.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

The present invention is a hanger clip 10. The hanger clip 10 includes an elongated main body 12. The sides of the main body 12 have no irregularities in shape so that the main body may be passed easily through a series of hangers.

Figure 1:
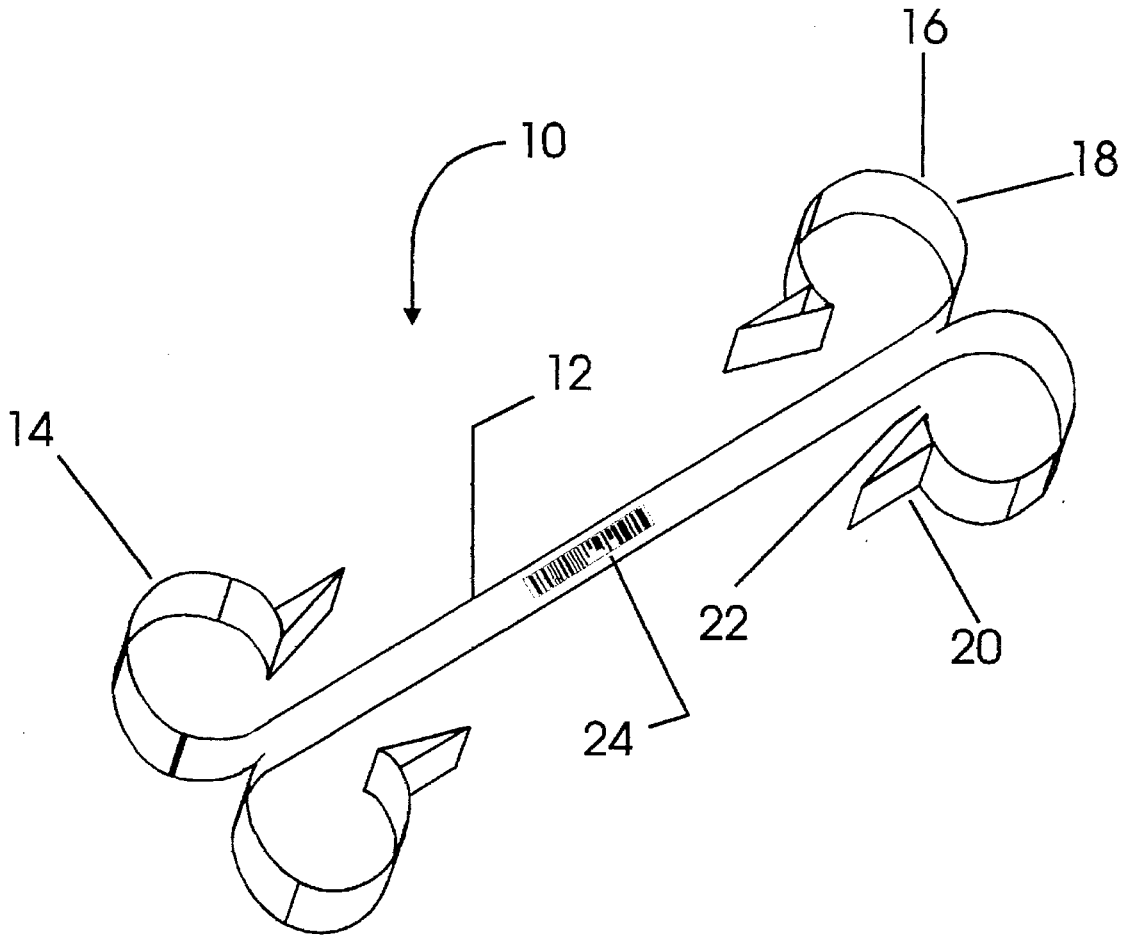
FIG. 1. a top view of the hanger clip of the present invention.
Figure 2:
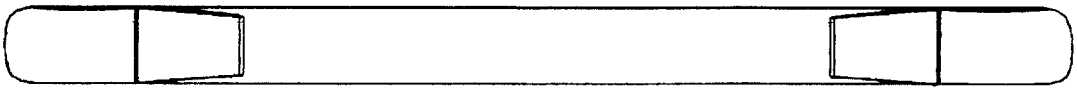
FIG. 2. a side view of the hanger clip.
Figure 3:
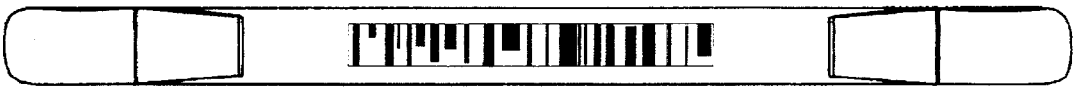
FIG. 3. a side view of the hanger clip with a bar code attached.
Figure 4:
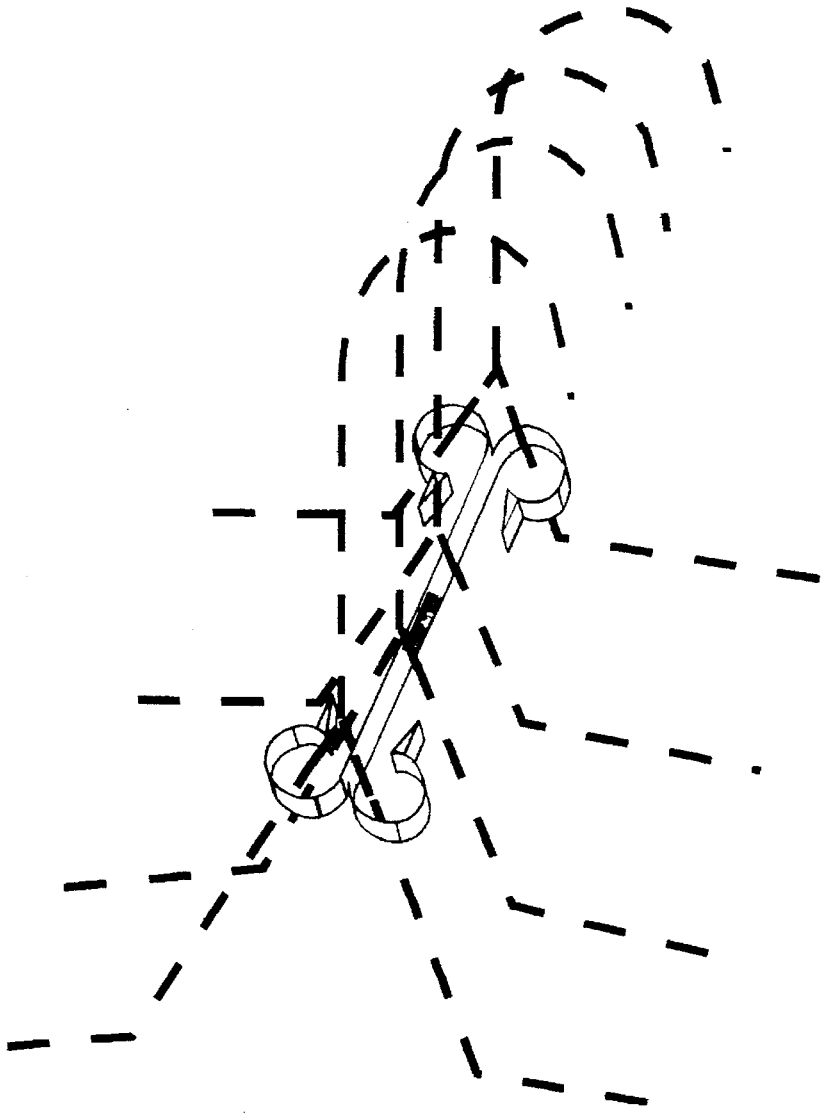
FIG. 4. a perspective view of the hanger clip.

Situated at either end of the main body 12 is a hanger securing means 14. Many structures can be utilized for the securing means, but in the preferred embodiment, the hanger securing means 14 each include a pair of gripping hooks 16. The gripping hooks 16 are adapted to encircle the wire of a hanger on either side of the throat area of the hanger as illustrated in FIG. 4.

The gripping hooks 16 include an essentially circular enclosing portion 18. The enclosing portion 18 terminates in a tapered inlet clip 20. An opening 22 allows a segment of the hanger being segregated to be inserted into the enclosing portion 18. The size of the opening 22 is such that hangers of standard thickness must be slightly forced to pass through the opening 22. The hanger clip 10 is made of a resilient material so that after the hanger has been forced through the opening 22, the inlet clip 20 rebounds to its original position and holds the hanger in place.

In order to facilitate tracking of the orders, a scanner identifiable tag 24 is installed on the side of the main body 12. The scanning identifier can be a bar code, a chip, or any other device that can be scanned for identification purposes.

Operation of the hanger clip 10 is as follows: A user identifies the group of clothes to be segregated. The hanger clip 10 is inserted into the open throat area of the subject hangers. The hanger clip 10 is moved upward until the width of the throat of the hanger is approximately equal to the width of the main body 12 of the hanger clip 10.

One end of the hanger clip 20 is then forced over the first hanger in the selected group, so that the enclosing portion secures the clip 10 in place on the first hanger. The second end of the hanger clip 10 is then placed on the last hanger in the selected group, so that the group is marked and secured for easy identification and transport.

If there are more hangers in a group than can be comfortably fit within one hanger clip 10, multiple clips 10 may be chained together to group any number of garments. For example, if the hanger clip 10 will comfortably group five hangers, and the user desires to segregate seven garments, the clips can be chained as follows: a first clip is attached at hangers 1 and 4, while a second clip is attached at hangers 4 and 7. In this manner, even the largest orders can be quickly and easily grouped for the customer.

While nearly any resilient material would be suitable for the clip of the present invention, it is envisioned that the preferred embodiment will be formed from plastic.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A hanger clip comprising:

an elonqated main body, the main body being free from any depressions or projections that would impede the clip's progress throuqh a series of hangers a hanger securing means located at each end of the main body, the securing means including means to allow the clip to be urged over a wire hanger, and means to then secure the clip in position on the hanger; wherein the hanger securing means each include a pair of gripping hooks, the gripping hooks are adapted to encircle the wire hanger on either side of a throat area of the hanger, the gripping hooks include an essentially circular enclosing portion with an opening therein, a terminal end of the enclosing portion includes a tapered inlet clip, the tapered inlet clip guides the hanger toward the opening in the gripping hooks, the size of the opening being such that hangers of standard thickness must be slightly forced to pass through the opening, the clip being formed from a resilient material so that after the hanger is forced through the opening, the inlet clip rebounds to secure the clip in place on the hanger.

2. The hanger clip of claim 2 wherein:

said clip comprises a scanner identifiable tag.

3. The hanger clip of claim 2 wherein:

said clip comprises a scanner identifiable tag.

* * * * *